US008418369B1

(12) United States Patent
Laube

(10) Patent No.: US 8,418,369 B1
(45) Date of Patent: Apr. 16, 2013

(54) CLIPPER LEVER SUPPORT INSERT

(76) Inventor: Kim Laube, Thousand Oaks, CA (US)

( * ) Notice: Subject to any disclaimer, the term of this patent is extended or adjusted under 35 U.S.C. 154(b) by 0 days.

(21) Appl. No.: 12/586,801

(22) Filed: Sep. 28, 2009

Related U.S. Application Data

(63) Continuation-in-part of application No. 11/137,250, filed on May 25, 2005, now abandoned, which is a continuation-in-part of application No. 10/680,027, filed on Oct. 7, 2003, now abandoned.

(51) Int. Cl.
*B26B 19/28* (2006.01)

(52) U.S. Cl.
USPC ..... 30/216; 30/210; 30/218; 30/219

(58) Field of Classification Search ..... 30/43.92, 30/44, 45, 210, 216, 217, 218, 219
See application file for complete search history.

(56) References Cited

U.S. PATENT DOCUMENTS

| | | | | | |
|---|---|---|---|---|---|
| 2,141,582 | A * | 12/1938 | Wimberger | 30/34.1 |
| 2,174,039 | A * | 9/1939 | Muros | 30/346.51 |
| 2,294,713 | A * | 9/1942 | Boerger | 30/123 |
| 2,355,130 | A * | 8/1944 | Yerkes | 75/600 |
| 2,510,844 | A * | 6/1950 | Van Armbruster et al. | 74/50 |
| 2,773,306 | A * | 12/1956 | Ranson | 30/43.92 |
| 2,790,236 | A * | 4/1957 | Andis | 30/210 |
| 3,031,758 | A * | 5/1962 | Wahl | 30/201 |
| 3,067,511 | A * | 12/1962 | Wahl | 30/43.92 |
| 3,201,866 | A * | 8/1965 | Parrello | 30/43.92 |
| 3,218,708 | A * | 11/1965 | Spohr | 30/43.92 |
| 3,570,122 | A * | 3/1971 | Williams | 30/210 |
| 3,992,778 | A * | 11/1976 | Urbush | 30/216 |
| 4,531,291 | A * | 7/1985 | Laube | 30/216 |
| 4,700,476 | A * | 10/1987 | Locke et al. | 30/43.91 |
| 4,723,362 | A * | 2/1988 | Boerger | 30/218 |
| 5,259,116 | A * | 11/1993 | Laube | 30/216 |
| 6,318,216 | B1 * | 11/2001 | Eggert et al. | 81/61 |
| 6,865,813 | B2 * | 3/2005 | Pollak | 30/166.3 |
| 2006/0064878 | A1 * | 3/2006 | Melton et al. | 30/216 |

* cited by examiner

*Primary Examiner* — Hwei C Payer
(74) *Attorney, Agent, or Firm* — Dennis W. Beech

(57) ABSTRACT

The clipper lever support insert may be inserted into a clipper lever. A finger insert may have two approximately parallel sides formed from metal. The sides may be shaped to the approximate form of a drive finger side. A shaft end insert may have a plurality of sides approximately in the shape of a rectangular box formed from metal. The sides may be shaped to the approximate form of a motor end cavity side.

7 Claims, 2 Drawing Sheets

CLIPPER LEVER SUPPORT INSERT

CROSS-REFERENCE TO RELATED APPLICATIONS

This is a continuation-in-part application of U.S. patent application Ser. No. 11/137,250, filed May 25, 2005, now abandoned which is a continuation-in-part application of U.S. patent application Ser. No. 10/680,027, filed Oct. 7, 2003, now abandoned and claims the benefit thereof.

BACKGROUND OF THE INVENTION

This invention relates to devices for clipping hair on animals and humans, for clipping fabrics such as carpets and other products that may be groomed using cutting clippers that use a lever or engagement element between the clipper motor and the blades to move the blades. The new lever may include one or more support inserts for structural support of the lever during operation to reduce wear or damage to the lever.

Clipper levers also known as engagement elements are often used as part of the drive apparatus to transfer clipper electric motor power to an oscillating motion for movement of cutting blades for use in cutting hair on animals and humans. The lever may be fabricated from metal, plastic, composite material and the like. An often used material is plastic that may be molded as a lever. However, depending on the quality of the cutting blades that the lever may have to move, often at high speed such as 10,000 strokes a minute, the drive finger portion of the lever may become worn at a rapid rate thus requiring frequent replacement parts. Metal levers may be used, but they are often so noisy that their use may not be tolerated by the user or the customer, animal or human.

SUMMARY OF THE INVENTION

The present invention is directed to devices that may be inserted into a clipper lever. A finger insert may have two approximately parallel sides formed from metal. The sides may be shaped to the approximate form of a drive finger side. A shaft end insert may have a plurality of sides approximately in the shape of a rectangular box formed from metal. The sides may be shaped to the approximate form of a motor shaft end cavity side.

These and other features, aspects and advantages of the present invention will become better understood with reference to the following drawings, description and claims.

DETAILED DESCRIPTION

The following detailed description represents the best currently contemplated modes for carrying out the invention.

The description is not to be taken in a limiting sense, but is made merely for the purpose of illustrating the general principles of the invention.

Figure 1:
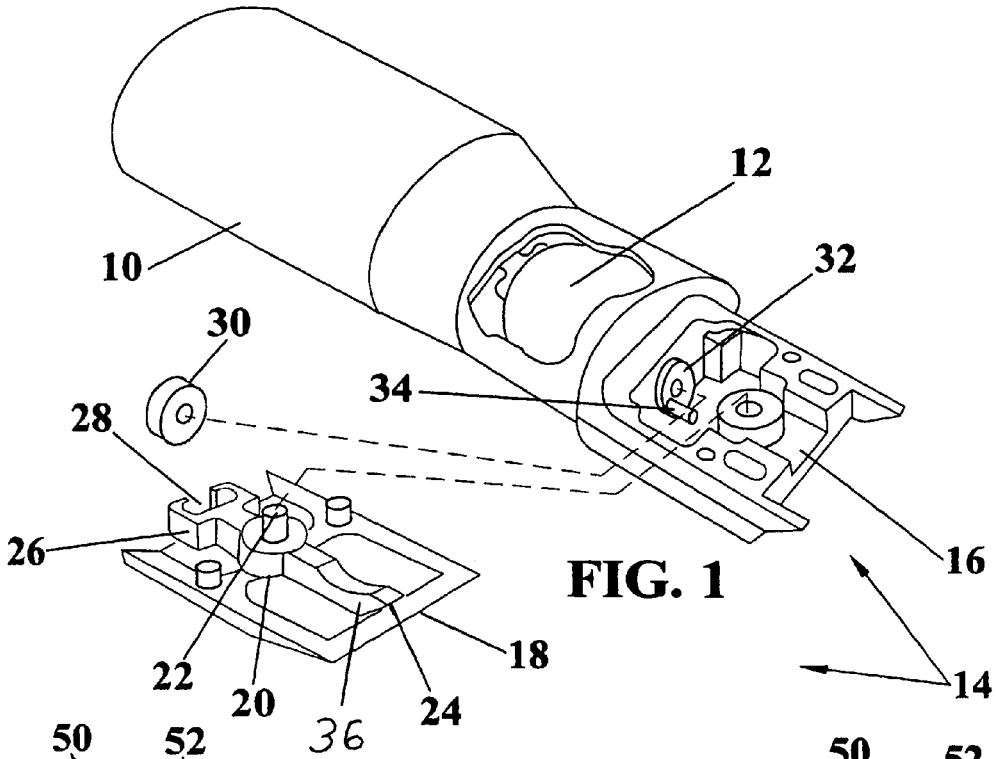
FIG. 1 illustrates a perspective partially disassembled view of a clipper according to an embodiment of the invention.

Referring to FIG. 1, a clipper 10 may have an electric motor 12 and a blade drive mechanism 14 that may have a lower portion 16 and a lever portion 18. A lever 20 may be rotatably mounted on a lever shaft 22. The lever 20 may have a drive finger 24 and motor end 26. The motor end 26 may have a cavity 28 for receipt of a bearing 30 that may engage a motor shaft drive end 32 that may have an off center shaft 34. While a particular eccentric motor shaft drive end 32 has been illustrated, this is made merely for the purpose of illustrating the general principals of a blade drive mechanism to oscillate a cutting blade for a clipper. Any motor shaft drive and blade drive mechanism using a lever may benefit from use of a support insert.

Figure 2:
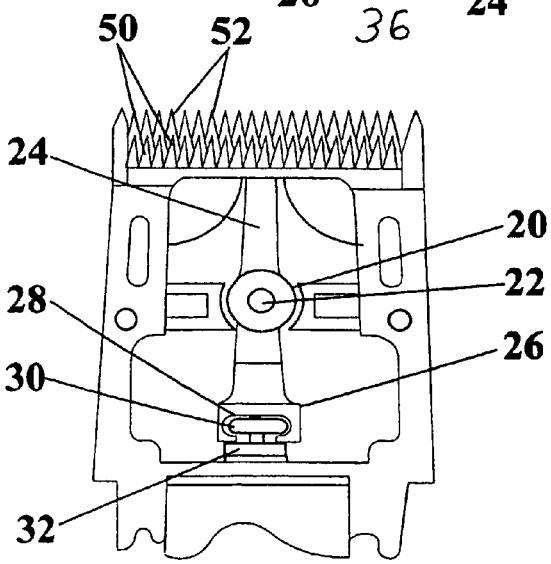
FIG. 2 illustrates a plan view of the lever and blade portion of a clipper according to an embodiment of the invention.
Figure 3:
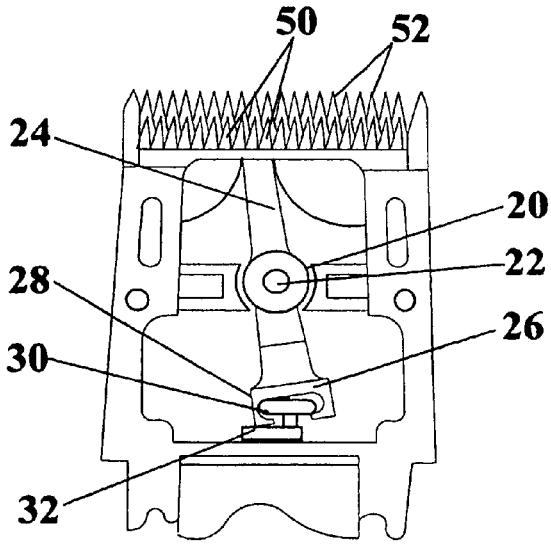
FIG. 3 illustrates a plan view of the lever and blade portion of a clipper with a blade moved to the left according to an embodiment of the invention.

Referring to FIGS. 2 and 3, the lever 20 may be viewed in a centered position in FIG. 2 and a left position in FIG. 3. The lever 20 is engaged at the drive finger 24 with the movable blade 50 to oscillate the movable blade 50 back and forth relative to the fixed blade 52 for the cutting action. The force of the lever 20 transferred from the motor shaft drive end 32 to the movable blade 50 may cause wearing of the drive finger 24 and the inner wall of the cavity 28. If the movable blade 50 may have a rough finish or sharp edges, the drive finger 24 may experience wear as well as may the motor shaft end 26. A lever 20 may have a drive finger insert and a motor end insert fabricated as part of the lever 20.

Figure 4:
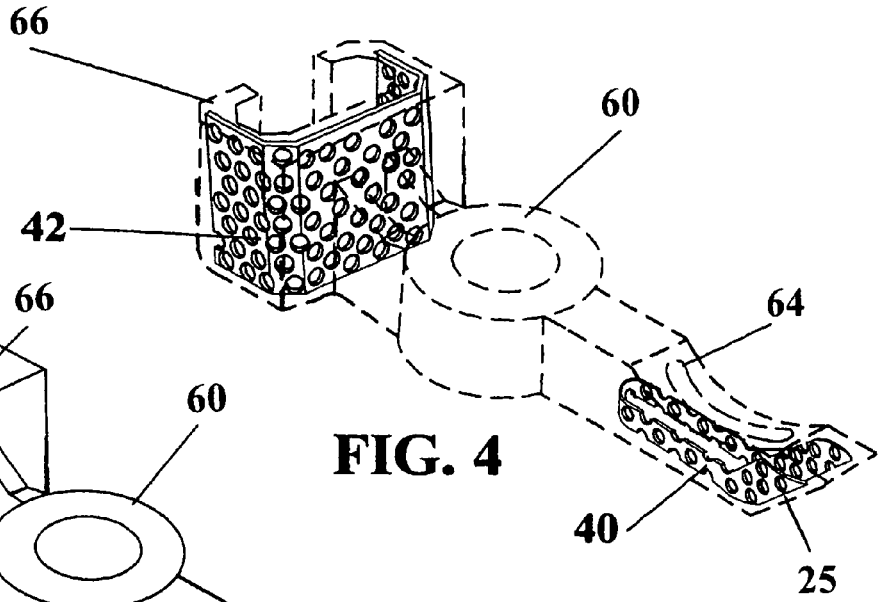
FIG. 4 illustrates a perspective view of a lever and support inserts according to an embodiment of the invention.
Figure 5:
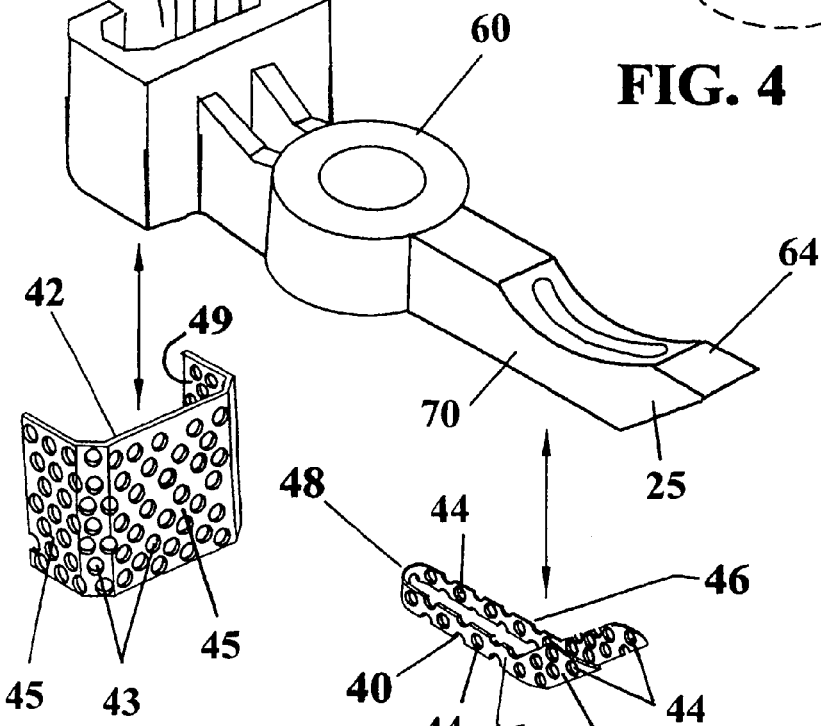
FIG. 5 illustrates a perspective view of a lever and support inserts disassembled therefrom according to an embodiment of the invention.
Figure 6:
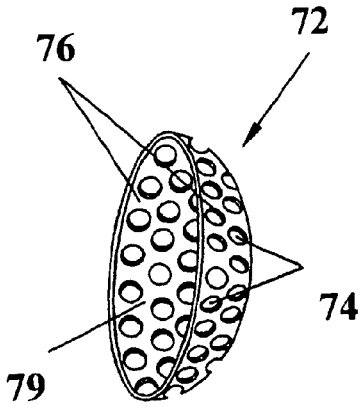
FIG. 6 is a perspective view of a lever motor shaft end support insert according to an embodiment of the invention.

Referring to FIGS. 4 through 6, a drive finger insert 40 and motor end insert 42 may be fabricated as part of a lever 60. Lever 60 has a slot illustrated in the drive finger 64 and intermediate the central portion and the motor end 66. The drive finger inserts and motor end inserts described may be used in the lever 20 illustrated in FIG. 1 as well as other levers that may be used in a blade drive mechanism. The inserts 40, 42 may be molded as elements of the lever 60 during the manufacturing process. A plastic composite may be used for the lever 60 that may have low friction quality that may serve to provide a film on the insert 40, 42 to reduce wear of the lever 60 during use. The plastic composite for the lever 60 may include material for example TEFLON, nylon, silicon, metal and the like that may create a plastic composite having a low friction characteristic. The plastic composite may fill apertures or holes 43, 44 in the inserts 40, 42 to continue to provide a film on the metal inserts 40, 42 outer surface when in use under conditions generating heat as between the movable blade 50 and drive finger 64. The inserts 40, 42 may be formed of a durable, rigid material that may maintain structural shape under conditions of heat, pressure, vibration and force as may be experienced in use by levers in clippers. Such material may be metal, carbon composite, glass, filter glass, graphite composites and the like.

The motor end or motor insert 42 may have three, four or more sides 45 or surfaces when used as an insert to support a cavity 68 type motor end 66. The motor end insert 42 may also be fabricated in other form factors, such as, circular, cylindrical, as a bowl and the like in order to conform to the shape of a cavity for the intended use. As an example, FIG. 6 illustrates a generally bowl shaped motor end insert 72 having only one side 76 in a concave shape with reference to the outward facing surface 79. There may be holes 74 similar to the description for holes 43, 44. The finger insert 40 may have two sides 46 to position the sides 46 on each drive finger side 70 of the drive finger 64. For the illustrated lever 60, the two sides 46 may be approximately parallel and spaced apart with a shape that approximates the form of the drive finger side 70 to provide support adjacent to the drive finger side 70, including a tip portion 25 for the drive finger 64 portion that engages a movable blade. Other forms of levers may have blade drive mechanisms with different shapes for which a different shape finger insert may be used for disposition adjacent the drive finger sides. There may be a bridge element 48 to position the sides 46 in the fabrication process, for example, to position a plastic composite film on an outward facing surface 47. Similarly, the motor end insert 42 may be formed or shaped to position a plastic composite film on an outward facing surface 49. The finger insert 40 may be attached at the bridge element 48 end to the motor end insert 42 to form a single insert depending on the type of lever used for a particular type of clipper. The finger insert 40 may have two sides shaped to the general form of a tip portion 25 of the drive finger 64.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for oscillating a movable blade of a clipper comprising;

a lever having a drive finger and a motor end;

a finger insert having two sides spaced apart and approximately parallel formed from a rigid, durable material;

each of said two sides of said finger insert shaped to an approximate form of each of two drive finger sides of said drive finger and disposed in said drive finger; and wherein said two sides of said finger insert are spaced apart sufficiently to position an outward facing surface of each one of said two sides of said finger insert adjacent and interior to each of said two drive finger sides, wherein said drive finger is formed of a plastic composite material and a portion of said plastic composite material forms a plastic composite film on each of said outward facing surfaces.

2. The device as in claim 1 wherein said two sides of said finger insert are perforated with apertures.

3. The device as in claim 1 wherein there is a bridge element attached between said two sides of said finger insert.

4. The device as in claim 1 wherein said finger device further comprises a motor end insert disposed in said motor end.

5. The device as in claim 1 wherein said two sides of said finger insert are shaped to a form of a tip portion of said drive finger for disposition relative to said tip portion engagement with a movable blade.

6. The device as in claim 1 wherein said rigid, durable material is a metal.

7. The device as in claim 1 wherein said rigid, durable material is a graphite composite material.

* * * * *